US009068496B2

(12) United States Patent
Beyer et al.

(10) Patent No.: US 9,068,496 B2
(45) Date of Patent: Jun. 30, 2015

(54) SYSTEM FOR COOLING AN ENGINE BLOCK CYLINDER BORE BRIDGE

(71) Applicant: Ford Global Technologies, LLC, Dearborn, MI (US)

(72) Inventors: Theodore Michael Beyer, Canton, MI (US); Jody Michael Slike, Farmington Hills, MI (US); Mathew Hintzen, Stockbridge, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 147 days.

(21) Appl. No.: 13/890,307

(22) Filed: May 9, 2013

(65) Prior Publication Data

US 2014/0331947 A1 Nov. 13, 2014

(51) Int. Cl.

| | |
|---|---|
| ***F02B 75/18*** | (2006.01) |
| ***F01P 3/02*** | (2006.01) |
| ***F02F 1/10*** | (2006.01) |

(52) U.S. Cl.

CPC . *F01P 3/02* (2013.01); *F02F 1/108* (2013.01); *F02F 2001/104* (2013.01)

(58) Field of Classification Search

USPC ..... 123/41.82 R, 41.72, 193.3, 193.5; 277/313, 591–596, FOR. 248

See application file for complete search history.

(56) References Cited

U.S. PATENT DOCUMENTS

| | | | | |
|---|---|---|---|---|
| 3,942,487 | A * | 3/1976 | Zink | 123/41.79 |
| 4,369,739 | A * | 1/1983 | Umemura et al. | 123/41.74 |
| 4,381,736 | A | 5/1983 | Hirayama | |
| 5,188,071 | A | 2/1993 | Han | |
| 5,558,048 | A * | 9/1996 | Suzuki et al. | 123/41.74 |
| 5,842,447 | A | 12/1998 | Krotky et al. | |
| 5,894,834 | A | 4/1999 | Kim | |
| 6,138,619 | A | 10/2000 | Etemad | |
| 6,470,839 | B2 | 10/2002 | Chang | |
| 6,688,262 | B2 | 2/2004 | Murakami et al. | |
| 6,688,263 | B1 | 2/2004 | Yamamoto et al. | |
| 6,776,127 | B2 | 8/2004 | Osman | |
| 6,883,471 | B1 | 4/2005 | Belter et al. | |
| 6,901,891 | B2 * | 6/2005 | Suzuki et al. | 123/41.79 |

(Continued)

FOREIGN PATENT DOCUMENTS

| | | |
|---|---|---|
| DE | 102008035955 | 3/2010 |
| DE | 102008042660 | 4/2010 |

(Continued)

OTHER PUBLICATIONS

Cylinder Heads, Tektronix, Integrated Publishing, , Dec. 9, 2000, http://www.tpub.com/engine3/en32-24.htm.

*Primary Examiner* — Hung Q Nguyen

(74) *Attorney, Agent, or Firm* — Greg P. Brown; Brooks Kushman P.C.

(57) ABSTRACT

An engine is provided with an open deck cylinder block having an open water jacket that surrounds a plurality of cylinders that are joined together in a Siamese design by a cylinder bore bridge. The engine also includes a cylinder head gasket, and a cylinder head. For the purpose of removing excess heat from the cylinder bore bridge, cooling channels are provided that allow coolant to flow from the engine block water jacket, across the cylinder bore bridge, and into a cylinder head coolant passageway. In addition, coolant is prevented from flowing from the water jacket on one side of the cylinders, across the bore bridge, and into the water jacket on the other side of the cylinders.

18 Claims, 4 Drawing Sheets

(56) References Cited

U.S. PATENT DOCUMENTS

| | | | |
|---|---|---|---|
| 6,976,683 | B2 | 12/2005 | Eckert et al. |
| 7,966,978 | B2 | 6/2011 | Maehara et al. |
| 8,256,389 | B2 | 9/2012 | Nomura et al. |
| 2002/0144666 | A1 | 10/2002 | Kobayashi et al. |
| 2010/0326380 | A1 | 12/2010 | Fedeson et al. |
| 2011/0023799 | A1 | 2/2011 | Lenz et al. |
| 2011/0197832 | A1 | 8/2011 | Berkemeier et al. |

FOREIGN PATENT DOCUMENTS

| | | | | | |
|---|---|---|---|---|---|
| JP | 62291417 | A | * | 12/1987 | ..... F01P 3/02 |
| JP | 04027710 | A | * | 1/1992 | ..... F01P 3/02 |

* cited by examiner

SYSTEM FOR COOLING AN ENGINE BLOCK CYLINDER BORE BRIDGE

TECHNICAL FIELD

This disclosure relates to cooling an internal combustion engine having a cylinder block with Siamese cylinders.

BACKGROUND

Internal combustion engines include cooling systems for removing excess heat that is produced from the combustion of fuel and friction of moving components. Removal of the excess heat is necessary to prevent the mechanical failure of engine components. The cooling systems typically include a liquid coolant that is pumped through passageways (sometimes known as water jackets) in the engine block, cylinder head, and other engine components. Heat is transferred to the liquid coolant from the engine components when the coolant flows through the various passageways in the engine components. Heat is then transferred from the liquid coolant to the surrounding environment through a heat exchanger, such as a radiator. Once the heat is transferred to the surrounding environment, the liquid coolant is redirected through the passageways in the engine components and the process is repeated.

An internal combustion engine having cylinders that share a common wall is known as a "Siamese design" and the common wall is known as the "bore bridge." The bore bridge will experience high temperatures because it is in close proximity to the two combustion chambers of the adjacent cylinders, and to the two sets of piston rings that transfer heat to the cylinder block. Packaging of a cooling system in the area of the bore bridge is also difficult adding to the increased temperature of the region.

Various efforts have been made to cool the bore bridge. It is known to drill cooling channels within the bore bridge that extend between the water jacket in the engine block and the cylinder head. This configuration presents limitations in the flow of the liquid coolant through channels in the bore bridge because of a limited pressure differential and channel cross sectional area.

It would be desirable to provide a cooling channel in the bore bridge that has an adequate pressure differential and flow area to allow liquid coolant to sufficiently flow through the channel.

SUMMARY

In at least one embodiment, an engine is provided having an open deck cylinder block that has a deck with an open water jacket that surrounds a number of cylinders, and has a Siamese design where the cylinders share a common wall known as the bore bridge. The bore bridge includes a cooling channel that is open to the deck and extends across the bore bridge from the water jacket on one side of the cylinder to an end point short of the water jacket on the other side. A cylinder head gasket has a bottom surface that is disposed on the deck of the cylinder block, and a cylinder head has a face surface that is disposed on a top surface of the cylinder head gasket. The cooling channel cooperates with the water jacket to enable coolant to flow from the water jacket to an inlet port in the cylinder head, the inlet port being located proximate to the end point the of cooling channel.

In at least one additional embodiment, an open deck cylinder block is provided. The open deck cylinder block has an open water jacket that surrounds the cylinders and has a Siamese design where the cylinders share a common wall known as the bore bridge. The bore bridge includes a cooling channel that is open to the deck and extends across the bore bridge from the water jacket on one side of the cylinder to an end point short of the water jacket on the other side.

In at least one additional embodiment, a cylinder head gasket for use in an engine having an engine block with an open deck Siamese cylinder design is provided. The generally planar gasket body has an upper surface that cooperates with a cylinder head and a lower surface that cooperates with a deck surface of an engine block. The cylinder head gasket has an inlet port in the lower surface that is open to the water jacket in the cylinder block and is adjacent to one side of a cylinder bore bridge that is formed between two Siamesed cylinders. An outlet port is formed in the upper surface of the cylinder head gasket and is adjacent to an opposite side of the cylinder bore bridge and open to a cylinder head coolant passageway. The outlet port is also sealed from the water jacket on the opposite side of the cylinder bore bridge. A first elongate cooling channel in the cylinder head gasket extends between the inlet and outlet ports for overlying and open to a second elongate cooling channel in the cylinder bore bridge, which enables coolant to flow from the water jacket on one side of the cylinder bore bridge, across the cylinder bore bridge, to the cylinder head coolant passageway on the opposite side of the cylinder bore bridge. The first elongate channel flares out at the outlet port to maintain a minimum summed cross sectional flow area of the first and second channels as a cross sectional flow area of the second elongate channel decreases.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1A:
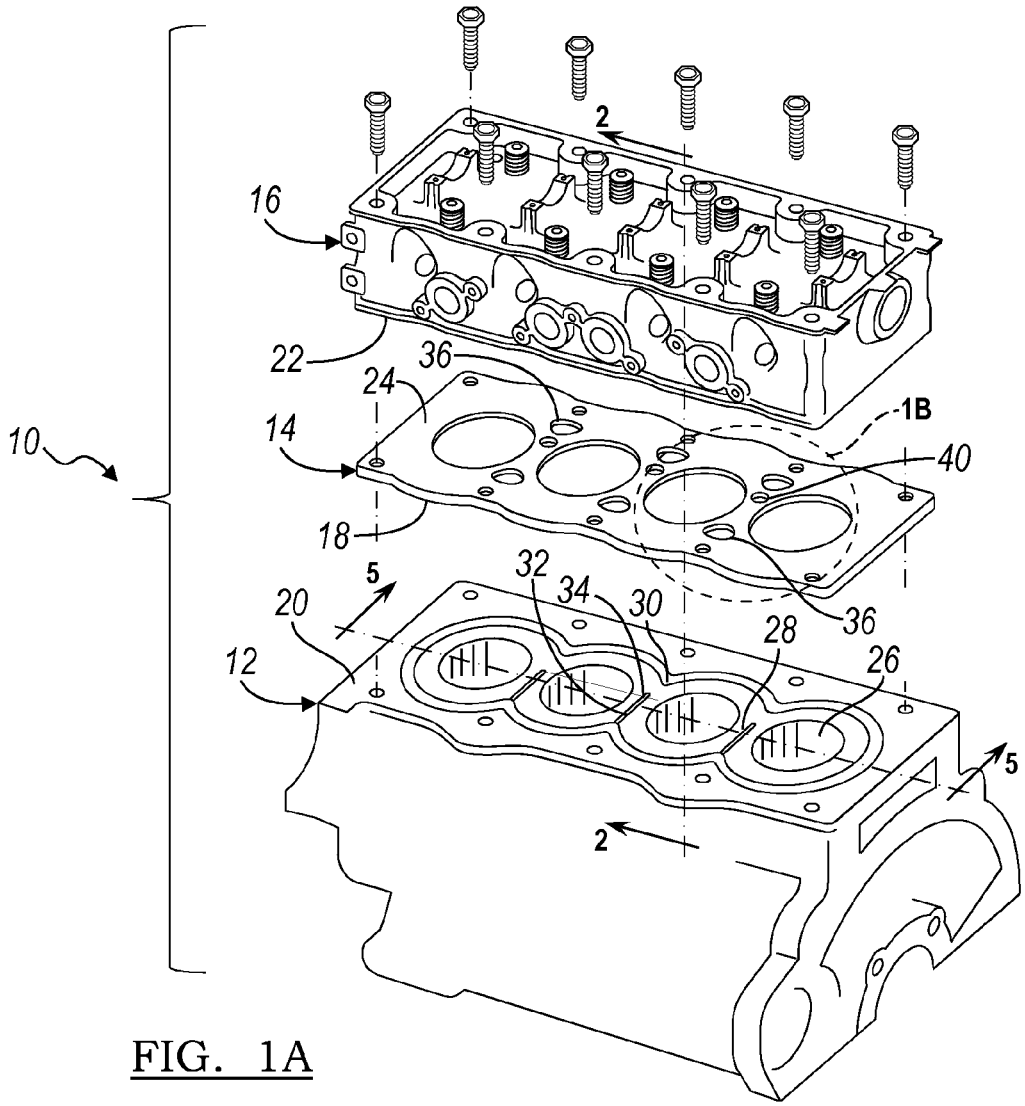
FIG. 1*a* is an exploded isometric view of the engine.

An exploded view of an internal combustion engine 10 according the present disclosure is illustrated in FIG. 1*a*. The engine 10 includes an open deck cylinder block 12, a cylinder head gasket 14, and a cylinder head 16. The cylinder head gasket 14 has a lower surface 18 that is disposed on the deck surface 20 of the cylinder block 12, and the cylinder head 16 has a face surface 22 that is disposed on the upper surface 24 of the cylinder head gasket 14.

Figure 2:
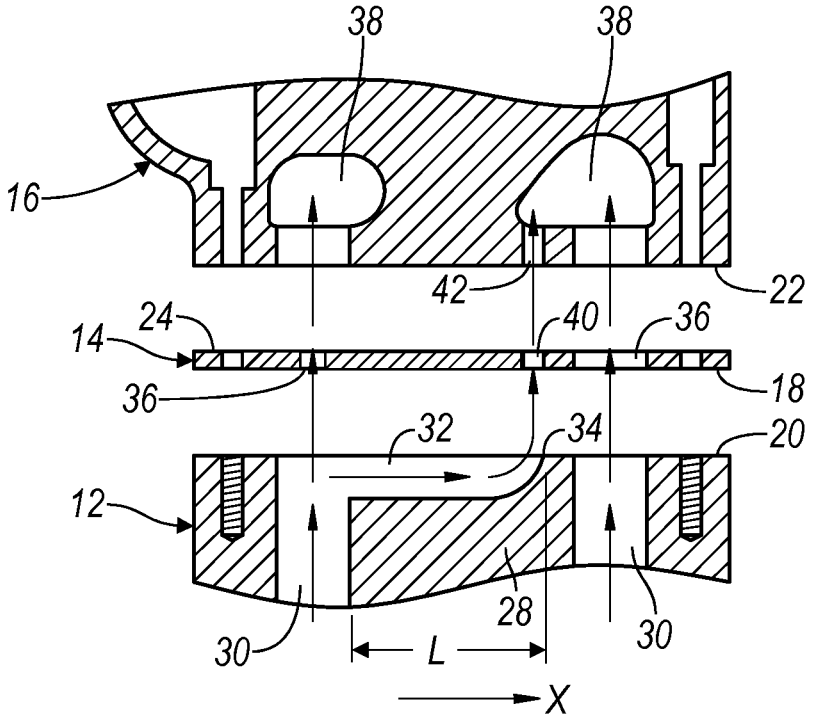
FIG. 2 is a transverse cross-sectional view taken along the line 2-2 of FIG. 1*a;*

FIGS. 1*a* and 2 show the cylinder block 12 having four cylinders 26 with a Siamese open deck design, where the adjacent cylinders 26 share a common wall known as the bore bridge 28. The deck surface 20 of the cylinder block 12 is open to a water jacket 30 that surrounds the cylinders 26. Cooling channels 32 located on the cylinder bore bridges 28 extend a length L from the water jacket 30 on one side of the bore bridge 28 to end points 34 short of the water jacket 30 on the other side of the bore bridge 28. Preferably, the length L of the cooling channel should extend over at least 70% of the length of the cylinder bore bridge, and more preferably the length of the cooling channel should extend from 80% to 95% across the length of the cylinder bore bridge.

Still referring to FIGS. 1*a* and 2, the cylinder head gasket 14 has openings 36 that allow coolant to flow from the water jacket 30 in the cylinder block 12 into a cooling passageway 38 located in the cylinder head 16. Additional openings 40 in the cylinder head gasket 14 allow coolant to flow from the water jacket 30 in the cylinder block 12 into the cooling channels 32 located on the cylinder bore bridges 28, from the cooling channels 32 into inlet ports 42 in the cylinder head 16, which are located proximate to the to end points 34 short of the water jacket 30 on the other side of the bore bridge 28, and from the inlet ports 42 into the cooling passageway 38 in the cylinder head 16. The cylinder head gasket 14 also creates a seal preventing coolant from flowing from the water jacket 30 on one side the cylinder bore bridge 28, across the cooling channels 32, and into the water jacket 30 on the other side of the cylinder bore bridge 28.

Figure 1B:
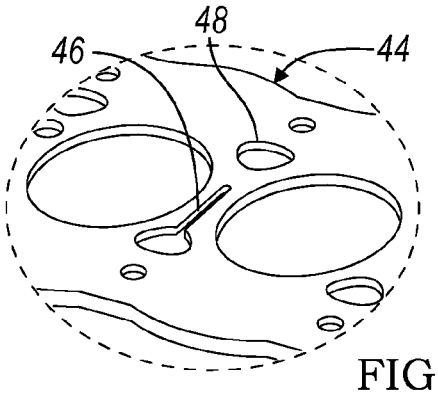
FIG. 1*b* is an alternative embodiment of the cylinder head gasket.

Referring to FIG. 1*b*, an alternative embodiment to the cylinder head gasket 44 is illustrated. The cylinder head gasket 44 includes openings 46 that connect the water jacket 30 in the cylinder block 12 on one side of the bore bridge 28 to the cooling passageway 38 in cylinder head 16 on the same side of the bore bridge. The openings 46 also connect the water jacket 30 in the cylinder block 12 on one side of the bore bridge 28 to the inlet ports 42 in the cylinder head 16 proximate the end points 34 short of the water jacket 30 on the other side of the bore bridge 28. This embodiment of the cylinder head gasket 44 also creates a seal preventing coolant from flowing from the water jacket 30 in the cylinder block 12 on one side the cylinder bore bridge 28, across the cooling channel 32, and into the water jacket 30 in the cylinder block 12 on the other side of the cylinder bore bridge 28. Additional openings 48 allow coolant to flow directly from the water jacket 30 in cylinder block 12 into the cooling passageway 38 in the cylinder head 16 on the side of the cylinder bore bridge 28 opposite of the cooling channel 32.

Figure 3:
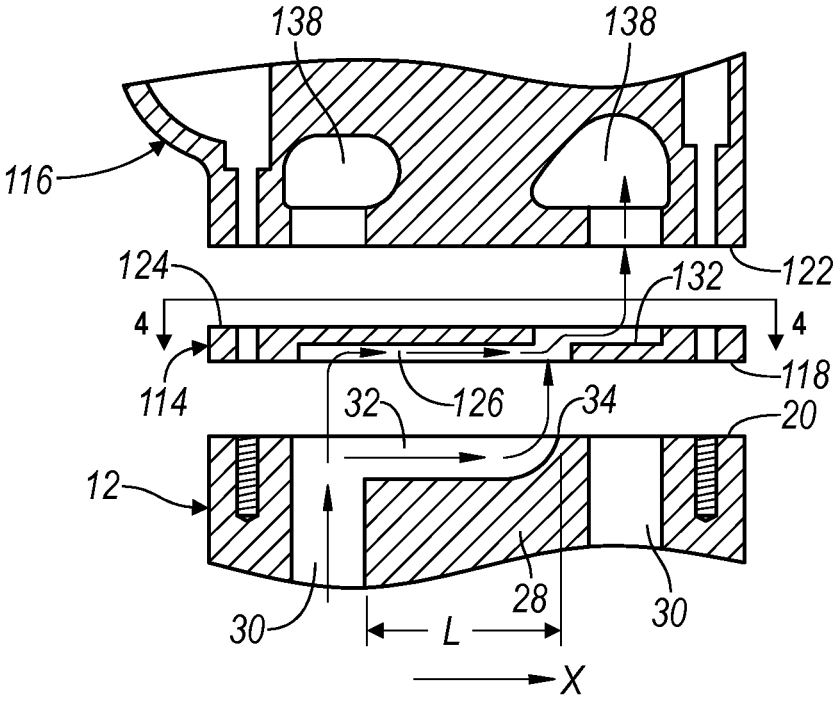
FIG. 3 is a similar to FIG. 2, but shows alternative embodiments of the cylinder head and cylinder head gasket, the cylinder head gasket is not to scale and is shown with an increased thickness for ease of illustration.
Figure 4:
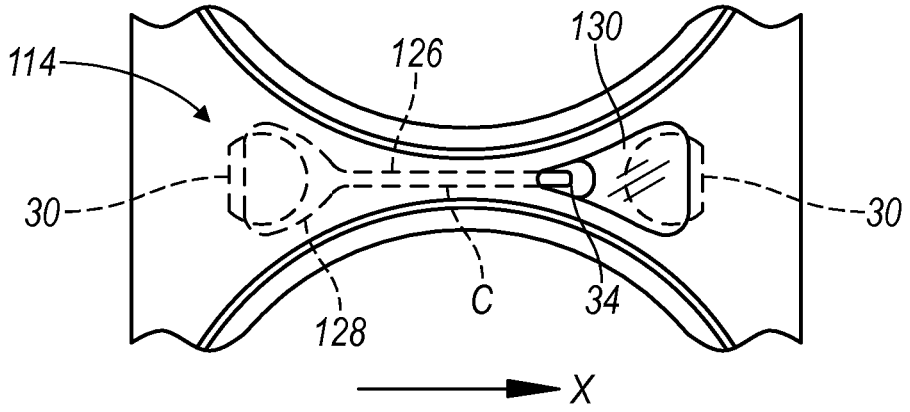
FIG. 4 is a plan view of the head gasket in FIG. 3.

Referring to FIGS. 3 and 4, an additional alternative embodiment of the cylinder head gasket 114 and an alternative embodiment of the cylinder head 116 are provided. The cylinder head gasket 114 has a lower surface 118 that is disposed on the deck surface 20 of the cylinder block 12, and the cylinder head 116 has a face surface 122 that is disposed on an upper surface 124 of the cylinder head gasket 114.

The cylinder head gasket 114 includes cooling channels 126. The cooling channels include inlet ports 128 that cooperate with the water jacket 30 of the cylinder block 12 allowing coolant to flow from the water jacket 30 into the cooling channels, and outlet ports 130 that cooperate with the cooling passageway 138 in the cylinder head 116, allowing coolant to flow from the cooling channels 126 into the cooling passageway 138. Between the water jacket 30 of the cylinder block 12 and the cooling passageway 138 in the cylinder head 116, the cooling channels 126 are open to and adjacent to the cooling channels 32 located on the cylinder bore bridge 28. At the outlet port 130, the cooling channel 126 includes a step 132 that creates a seal between the cooling channel 126 and the water jacket 30 on the other side of the bore bridge 28.

Figure 5:
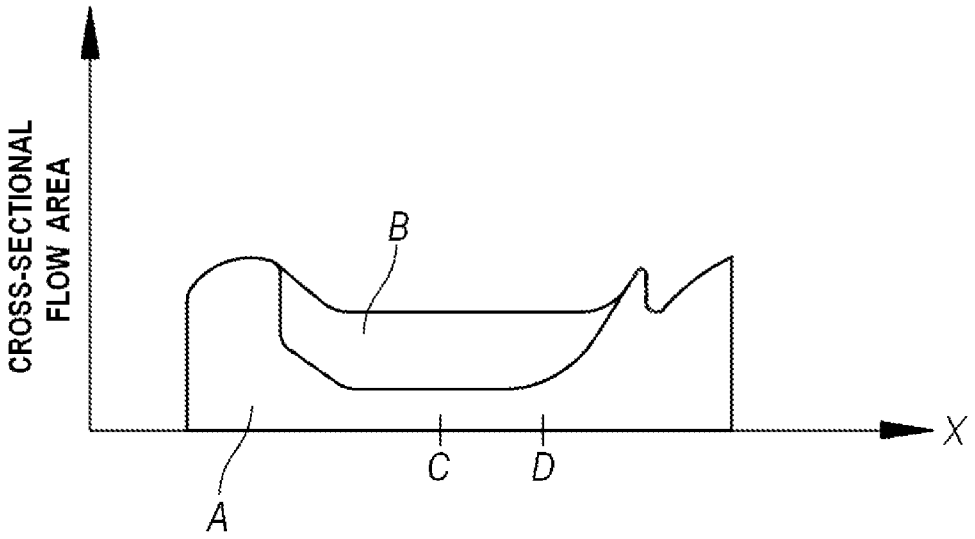
FIG. 5 illustrates a graph having a plot of the summed cross sectional flow areas of cooling channels in the cylinder block and head gasket versus a distance X.

Referring to FIGS. 3, 4, and 5, the cooling channels 126 in the cylinder head gasket 114 and the adjacent cooling channel 32 located on the cylinder bore bridge 28, have a summed cross sectional flow area. This summed cross sectional flow area is demonstrated by the graph in FIG. 5. The summed cross sectional flow area is maintained nearly constant in the proximity of a center point C of the cooling channel 126. Also, the summed cross sectional flow area will have a value equal to at least the value of the summed cross sectional area at the center point C, as you move in the direction X from the inlet port 128 of the cooling channel 126 to the outlet port 130. Setting the minimum value of the summed cross sectional flow area at the center point C will ensure that the flow of coolant is not restricted.

Referring to FIGS. 4 and 5, the portion of the cooling channel 126 of the cylinder head gasket 114 near the inlet port 128 has a large cross sectional flow area because the cooling channel 126 near the inlet port 128 is not running adjacent to the cooling channel 32 located on the cylinder bore bridge 28. As you move in the direction X, away from the inlet port 128 and toward the center point C, the portion of the summed cross sectional flow area represented by the cooling channel 126 (marked A) decreases as the portion summed cross sectional flow area represented by the cooling channel 32 (marked B) increases. As you move in the direction X, away from the center point C toward the outlet port 130, the cross sectional flow area B of the cooling channel 32 will begin to decrease at a point D beyond the center point C. When the cross sectional flow area B of the cooling channel 32 begins to decrease at point D, the cooling channel 126 begins to open up at the outlet port 130 and the cross sectional flow area A of the cooling channel 126 will begin to increase to ensure the summed cross sectional flow area remains at or above the value of the summed cross sectional flow area at the center point C.

Figure 6:
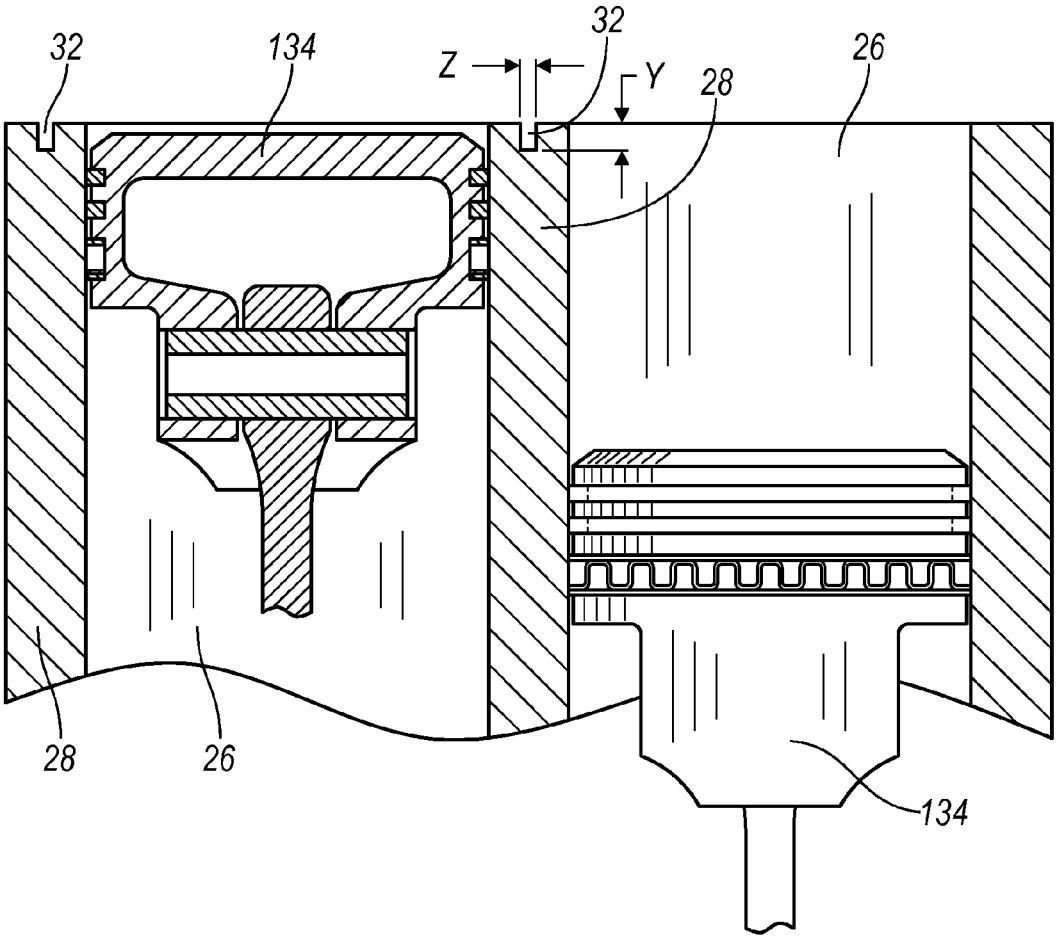
FIG. 6 is partial longitudinal cross-sectional view taken along line 5-5 of FIG. 1.

Referring to FIG. 6, a partial cross section of the cylinder block 12 shows a set of adjacent Siamesed cylinders 26 with pistons 134. The cooling channels 32 of the bore bridge 28 are shown having a depth Y and a width Z. Preferably, the depth Y should range between 3.0 mm and 8.0 mm. Preferably, the width Z being should be at least 0.75 mm, and more preferably, the width Z should range between 1.0 mm and 2.0 mm.

Although the preferred embodiments described above were directed to open deck cylinder blocks, the invention should not be construed as limited to open deck cylinder blocks and should include both open and closed deck cylinder blocks.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An engine comprising:

a cylinder block having a deck and a water jacket surrounding a plurality of cylinders joined together in a Siamese design by a cylinder bore bridge, the cylinder bore bridge having a first cooling channel formed therein open to the deck extending substantially across the cylinder bore bridge from the water jacket on one side to an end point short of the water jacket on the other side;

a cylinder head gasket having a second cooling channel, a top surface, and a bottom surface, the bottom surface disposed on the deck; and a cylinder head having a face surface, the face surface disposed on the top surface of the cylinder head gasket, wherein the second cooling channel is adjacent and open to the first cooling channel, and the second cooling channel extends along an entire length L of the first cooling channel, and wherein the first cooling channel and the second cooling channel cooperate with the water jacket to enable coolant to flow from the water jacket through the first and second cooling channels to an inlet port in the cylinder head face surface proximate the cooling channel end point.

2. The engine of claim 1, wherein the first cooling channel has a depth Y from the deck of the cylinder block being at least 3.0 mm.

3. The engine of claim 2, wherein the depth Y ranges between 3.0 mm and 8.0 mm.

4. The engine of claim 1, wherein the length L of the first cooling channel extends over at least 70% of the length of the cylinder bore bridge.

5. The engine of claim 4, wherein the length L of the first cooling channel extends from 80% to 95% across the length of the cylinder bore bridge.

6. The engine of claim 1, wherein the first cooling channel of the cylinder bore bridge has a width Z being at least 0.75 mm.

7. The engine of claim 6, wherein the width Z ranges between 1.0 mm and 2.0 mm.

8. The engine of claim 1, wherein the cylinder head gasket prevents the coolant from flowing through the first and second cooling channels from the water jacket on one side of the cylinder bore bridge to the water jacket on the other side.

9. The engine of claim 1, wherein the cylinder block has an open deck.

10. The engine of claim 1, wherein a cross-sectional area of the second cooling channel increases prior to the end point.

11. The engine of claim 10, wherein a cross-sectional area of the first cooling channel decreases prior to the end point.

12. The engine of claim 11, wherein the cross-sectional area of the second cooling channel is increased such that a minimum summed cross sectional flow area of the first and second cooling channels is maintained as the cross-sectional area of the first cooling channel decreases.

13. The engine of claim 1, wherein the second cooling channel flares out prior to the end point to maintain a minimum summed cross sectional flow area of the first and second cooling channels as a cross sectional flow area of the first cooling channel decreases.

14. A cylinder head gasket for use in an engine having a cylinder block with a Siamese cylinder design, the gasket comprising:

a generally planar gasket body having an upper surface for cooperation with a cylinder head and a lower surface for cooperating with a deck surface of the cylinder block, the gasket having formed therein:

an inlet port in the lower surface open to a water jacket in the cylinder block adjacent to one side of a cylinder bore bridge formed between two Siamesed cylinders;

an outlet port formed in the upper surface adjacent to an opposite side of the cylinder bore bridge, open to a cylinder head coolant passageway and sealed from the water jacket in the cylinder block; and a first elongate cooling channel extending between the inlet and outlet ports for overlying and open to a second elongate cooling channel in the deck surface of the cylinder block extending partially across the cylinder bore bridge from the water jacket adjacent the inlet port and terminating at an end point short of the water jacket on the other side, enabling coolant to flow from the water jacket on one side of the cylinder bore bridge, across the cylinder bore bridge, to the cylinder head coolant passageway on the opposite side of the cylinder bore bridge, wherein, the first elongate cooling channel flares out prior to the second elongate cooling channel end point to maintain a minimum summed cross sectional flow area of the first and second channels as a cross sectional flow area of the second elongate channel decreases.

15. A cylinder head gasket comprising:

a first cooling channel open and adjacent to a second cooling channel located in a cylinder bore bridge, the cooling channels originating at a cylinder block water jacket on one side of the bridge and terminating at a cylinder head water jacket short of the other side of the bridge, wherein a cross-sectional area of the first cooling channel increases prior to the cylinder head water jacket.

16. The cylinder head gasket of claim 15, wherein a cross-sectional area of the second cooling channel decreases prior to the cylinder head water jacket.

17. The cylinder head gasket of claim 16, wherein the cross-sectional area of the first cooling channel is increased such that a minimum summed cross sectional flow area of the first and second cooling channels is maintained as the cross-sectional area of the second cooling channel decreases.

18. The cylinder head gasket of claim 15, wherein the first cooling channel flares out prior to the cylinder head water jacket to maintain a minimum summed cross sectional flow area of the first and second cooling channels as a cross sectional flow area of the second cooling channel decreases.

* * * * *